US010821320B2

(12) United States Patent
Lo

(10) Patent No.: US 10,821,320 B2
(45) Date of Patent: Nov. 3, 2020

(54) CUSHION ASSEMBLY OF A TREADMILL

(71) Applicant: DK City Corporation, Taichung (TW)

(72) Inventor: Chiu-Hsiang Lo, Taichung (TW)

(73) Assignee: DK CITY CORPORATION, Taichung (TW)

( * ) Notice: Subject to any disclaimer, the term of this patent is extended or adjusted under 35 U.S.C. 154(b) by 46 days.

(21) Appl. No.: 16/181,429

(22) Filed: Nov. 6, 2018

(65) Prior Publication Data

US 2019/0344117 A1 Nov. 14, 2019

(30) Foreign Application Priority Data

May 10, 2018 (TW) ..... 107206075 U

(51) Int. Cl.
*A63B 22/02* (2006.01)

(52) U.S. Cl.
CPC ..... *A63B 22/0214* (2015.10)

(58) Field of Classification Search
CPC ..... A63B 22/0214; A63B 1/00
See application file for complete search history.

(56) References Cited

U.S. PATENT DOCUMENTS 3,941,377 A * 3/1976 Lie ..... A63B 22/0012 482/70
4,334,676 A * 6/1982 Schonenberger ..... A63B 22/02 482/54
4,509,510 A * 4/1985 Hook ..... A61H 7/001 156/292
4,925,183 A * 5/1990 Kim ..... G09B 9/058 482/61
5,158,073 A * 10/1992 Bukowski ..... A61H 39/04 5/944
5,250,067 A * 10/1993 Gelfer ..... A61H 39/00 606/185
5,470,293 A * 11/1995 Schonenberger ..... A63B 22/02 482/54
5,527,241 A * 6/1996 Peng ..... A61H 7/001 482/51
5,690,587 A * 11/1997 Gruenangerl ..... A63B 22/02 482/54
6,042,514 A * 3/2000 Abelbeck ..... A63B 22/02 198/439
6,162,150 A * 12/2000 Lee ..... A63B 23/03533 482/51
6,860,836 B1 * 3/2005 Wu ..... A63B 22/001 198/850
6,918,859 B1 * 7/2005 Yeh ..... A61H 7/001 482/54
7,195,582 B2 * 3/2007 Wu ..... A63B 22/001 198/850
7,510,511 B2 * 3/2009 von Detten ..... A63B 22/02 482/54
7,563,205 B2 * 7/2009 Alling ..... A63B 22/0235 482/4

(Continued)

*Primary Examiner* — Garrett K Atkinson
(74) *Attorney, Agent, or Firm* — Bruce Stone LLP; Joseph A. Bruce

(57) ABSTRACT

A treadmill includes a frame, a tread assembly and two cushion assemblies. Each of the cushion assemblies includes a supporting element and at least one buffering element. An upper portion of the tread assembly is supported on the supporting element. The buffering element is provided between the supporting element and the frame.

1 Claim, 13 Drawing Sheets

(56) References Cited

U.S. PATENT DOCUMENTS

| | | | | |
|---|---|---|---|---|
| 7,976,437 | B1 * | 7/2011 | von Detten | A63B 22/0235 482/54 |
| 8,721,504 | B2 * | 5/2014 | Wang | A63B 22/02 482/54 |
| 9,937,375 | B2 * | 4/2018 | Zhu | A63B 22/0214 |
| 10,449,412 | B2 * | 10/2019 | Zhu | A63B 22/0214 |
| 2002/0177511 | A1 * | 11/2002 | Jang | A61H 15/00 482/146 |
| 2005/0221959 | A1 * | 10/2005 | Yeh | A61H 7/001 482/54 |
| 2007/0275827 | A1 * | 11/2007 | Glaser | A63B 21/4037 482/23 |
| 2008/0176719 | A1 * | 7/2008 | To | A63B 22/0235 482/54 |
| 2009/0088301 | A1 * | 4/2009 | Alling | A63B 24/00 482/54 |
| 2009/0170666 | A1 * | 7/2009 | Chiang | A63B 22/02 482/54 |
| 2012/0129654 | A1 * | 5/2012 | Wang | A63B 22/0228 482/4 |
| 2012/0283070 | A1 * | 11/2012 | Lai | A63B 22/02 482/54 |
| 2013/0035214 | A1 * | 2/2013 | Wang | A63B 22/02 482/54 |
| 2013/0130868 | A1 * | 5/2013 | Hou | A63B 22/02 482/54 |
| 2013/0130869 | A1 * | 5/2013 | Hou | A63B 22/0285 482/54 |
| 2018/0008862 | A1 * | 1/2018 | Zhu | A63B 22/0214 |
| 2018/0056119 | A1 * | 3/2018 | Zhu | A63B 22/0214 |

* cited by examiner

CUSHION ASSEMBLY OF A TREADMILL

BACKGROUND OF INVENTION

1. Field of Invention

The present invention relates to a treadmill and, more particularly, to a cushion assembly of a treadmill.

2. Related Prior Art

As disclosed in U.S. patent application Ser. No. 16/030,839, a treadmill includes an arched tread assembly including two belts 21, a number of slats 22 and a cushion 31. Each belt 21 includes apertures 28. Each slat 22 includes a rigid element 30 and two threaded bolts 35. The rigid element 30 includes two apertures 301, an external face, and an internal face in contact with the belts 21. A middle section 352 of each threaded bolt 35 is inserted in a corresponding aperture 301 of the rigid element 30 so that the threaded bolts 35 cannot be rotated relative to the rigid element 30. A terminal section 351 of each threaded bolt 35 is located on an external face of the rigid element 30. Another terminal section 353 of each threaded bolt 35 is inserted in one of the aperture 28 of one of the belts 21. The cushion 31 includes an internal face in contact with the external face of the rigid element 30 and an external face extending higher than the first external section 351 of each of the threaded bolts 35. The cushion 31 absorbs shocks and reduces noise when the treadmill is in operation. However, the cushion 31, which is particularly useful for the arched tread assembly, is complicated, the assembling of the treadmill is hence troublesome, and the cost of the treadmill is hence high.

The present invention is therefore intended to obviate or at least alleviate the problems encountered in prior art.

SUMMARY OF INVENTION

It is the primary objective of the present invention to provide a treadmill with a simple, easy-to-make and inexpensive cushion assembly.

To achieve the foregoing objective, the cushion assembly includes a supporting element and at least one buffering element. An upper portion of a tread assembly of the treadmill is supported on the supporting element. The buffering element is provided between the supporting element and a frame of the treadmill.

Other objectives, advantages and features of the present invention will be apparent from the following description referring to the attached drawings.

BRIEF DESCRIPTION OF DRAWINGS

The present invention will be described via detailed illustration of several embodiments referring to the drawings wherein.

DETAILED DESCRIPTION OF EMBODIMENTS

Figure 1:
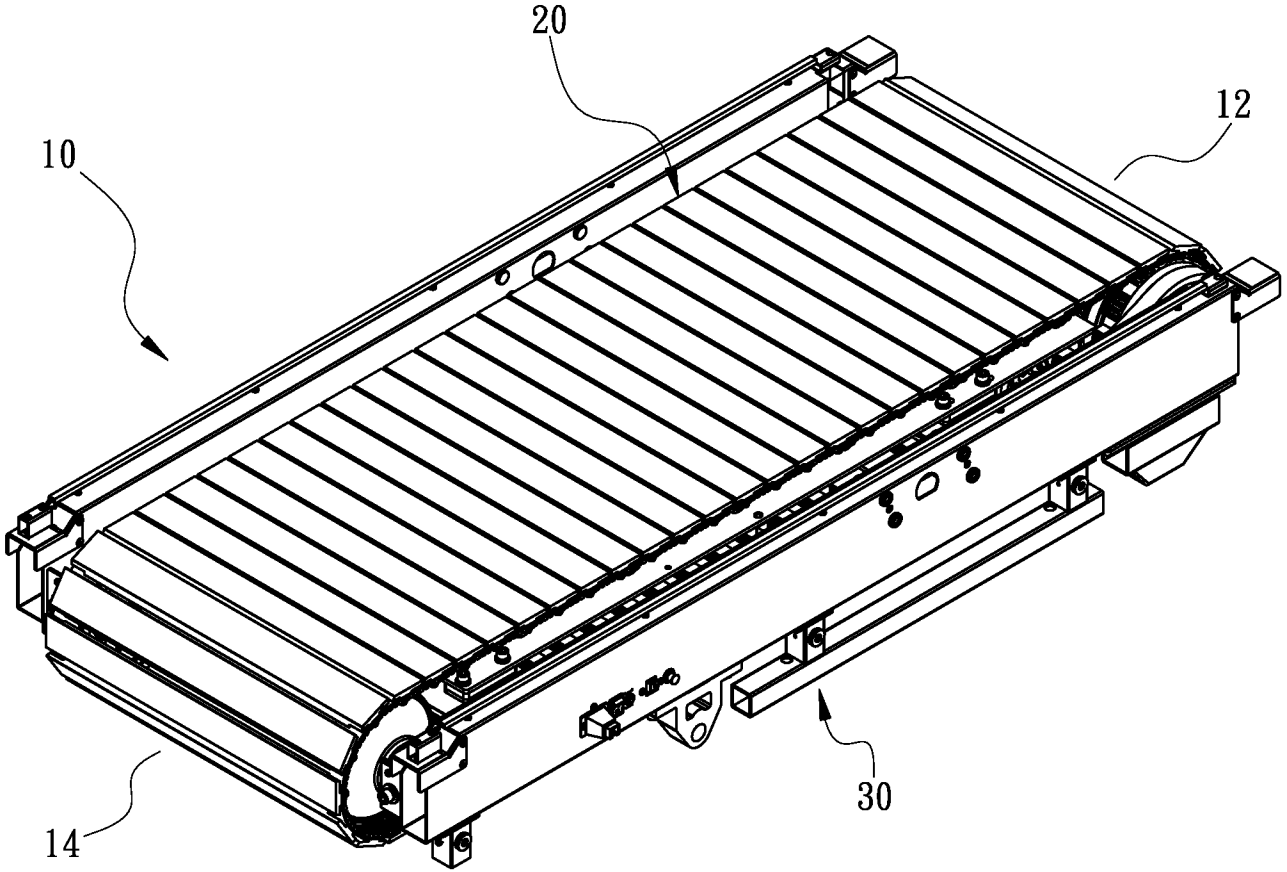
FIG. 1 is a perspective view of a treadmill provided with a cushion assembly according to a first embodiment of the present invention.
Figure 2:
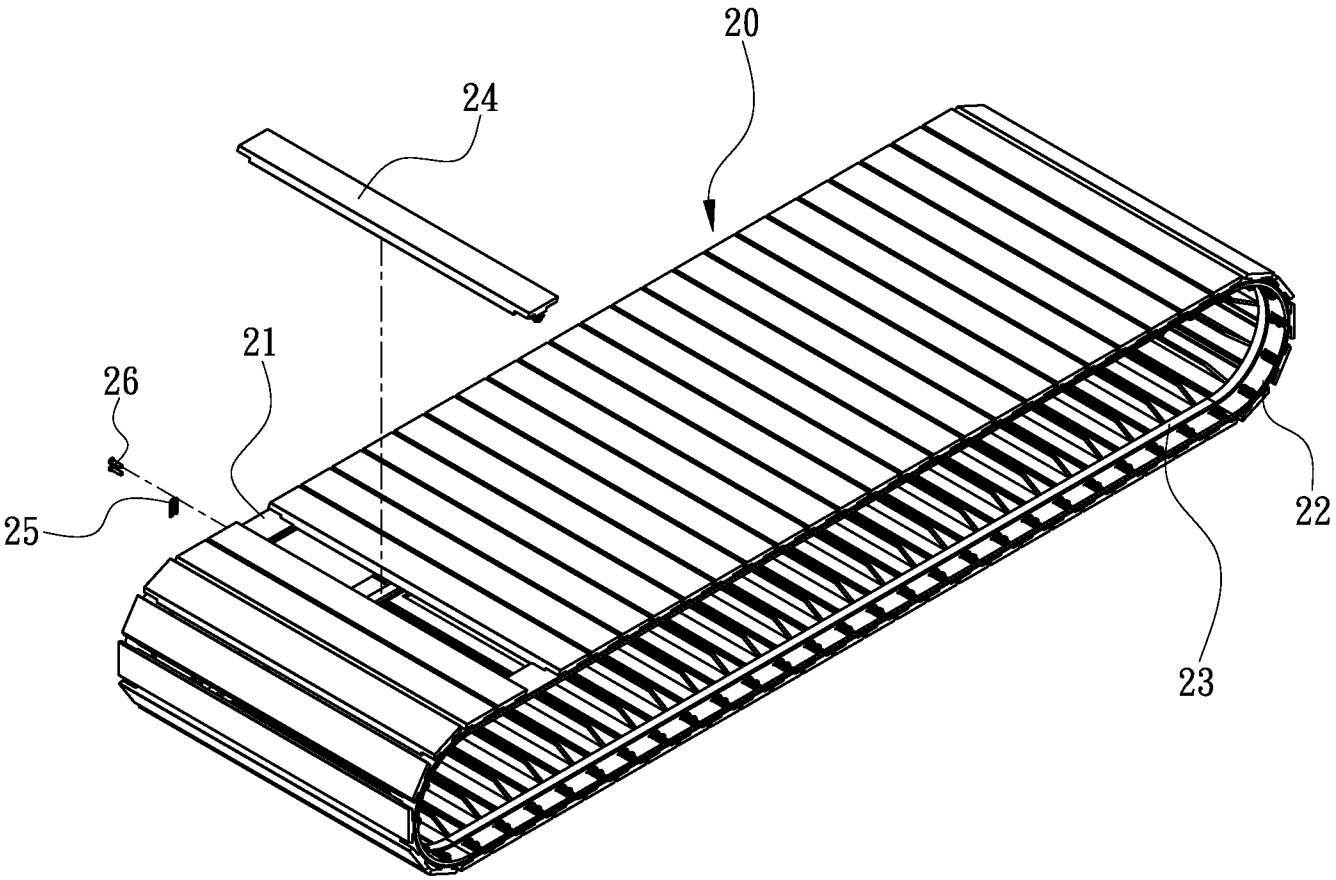
FIG. 2 is a perspective view of a running belt of the treadmill shown in FIG. 1.

Referring to FIG. 1, a treadmill 10 is equipped with a tread assembly 20, a frame 30 and two cushion assemblies 40 according to a first embodiment of the present invention. The treadmill 10 is formed with a rear end 12 and a front end 14. The tread assembly 20 is movably supported on the frame 30. The tread assembly 20 includes an upper portion that preferably extends horizontally when the treadmill 10 is in operation.

Figure 3:
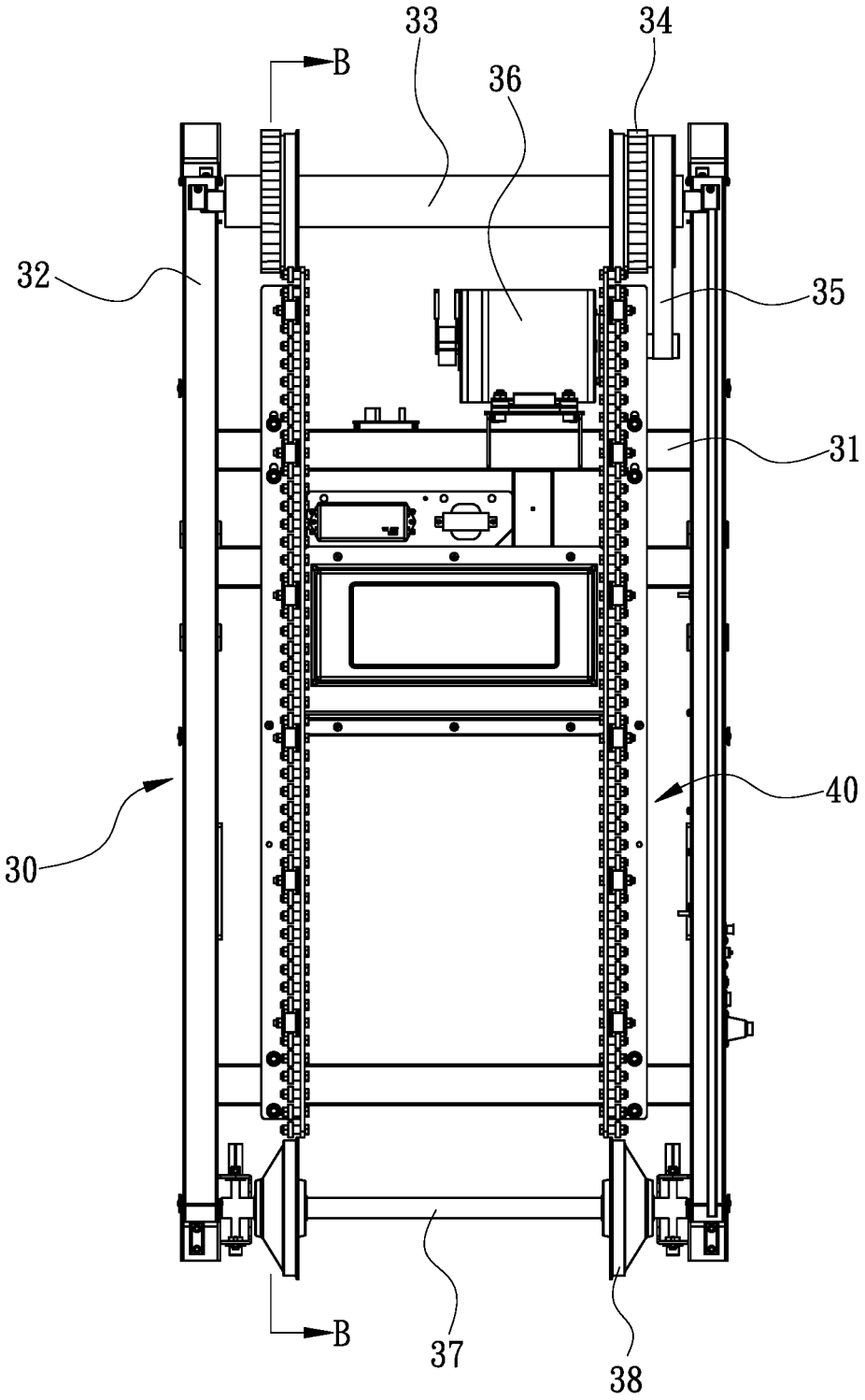
FIG. 3 is a top view of the treadmill shown in FIG. 1 without the running belt shown in FIG. 2.

Referring to FIG. 3, the frame 30 includes three crossbars 31 located between and connected to two lateral bars 32. Preferably, the crossbars 31 and the lateral bars 32 are tubes. A shell (not shown) can be connected to each of the lateral bars 32 by threaded bolts, rivets or soldering for example. Such shells are intended to protect the frame 30.

A major axle 33, a motor 36 and a minor axle 37 are supported on the frame 30. The major axle 33 is supported on the lateral bars 32. Two major wheels 34 are connected to the major axle 33 so that they are rotatable together. The minor axle 37 is rotationally supported on the lateral bars 32. The major axle 33 and the minor axle 37 are located near two opposite ends of the frame 30. Two minor wheels 38 are connected to the minor axle 37 so that they are rotatable together. The major wheels 34 and the minor wheels 38 are supported on the cushion assembly 40 in a manner to be described. The motor 36 is connected to at least one of the crossbars 31. The motor 36 is connected to the major axle 33 via a transmission 35 so that the major axle 33 is rotatable by the motor 36. In the first embodiment, the transmission 35 is a pulley-and-belt combination. The transmission 35 can however be a gear train, a sprocket-and-chain combination or any other proper transmission in another embodiment.

Referring to FIGS. 2 and 4 through 7, the tread assembly 20 is shaped like a caterpillar. The tread assembly 20 includes two loops 21 connected to a number of slats 24. The slats 24 are kept in position relative to the loops 21 by linking strips 25 and fasteners 26. Each of the loops 21 includes a number of engagement portions 22 and a tracking portion 23. The tracking portions 23 of the loops 21 are located between the series of engagement portions 22 of the loops 21.

The tread assembly 20 extends around the major axle 33 and the minor axle 37. Each of the loops 21 extends around a corresponding one of the major wheels 34 and a corresponding one of the minor wheels 38. The engagement portions 22 of the loops 21 are engaged with corresponding portions of the major wheels 34 so that the loops 21 are drivable by the major wheels 34. When actuated, the motor 36 rotates the major axle 33 via the transmission 35. The major wheel 34 cooperates with the minor wheel 38 to drive the tread assembly 20 on the frame 30. More details of the engagement of the tread assembly 20 with the major wheel 34 are given in U.S. patent application Ser. No. 16/030,839.

Figure 4:
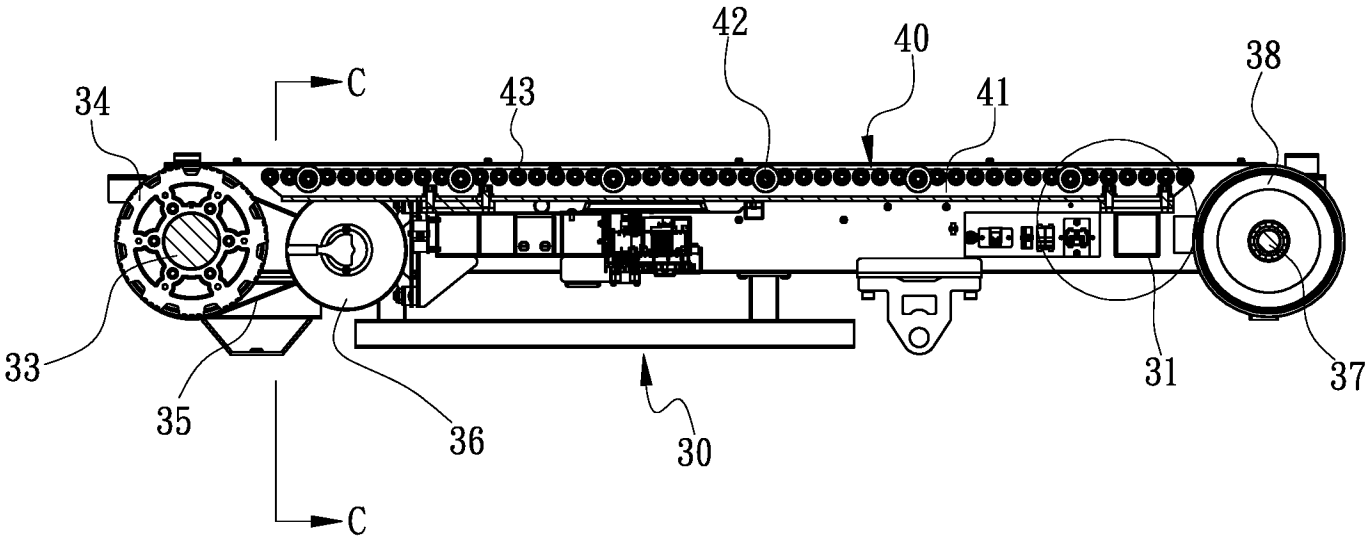
FIG. 4 is a cross-sectional view of the treadmill taken along a line B-B shown in FIG. 3.
Figure 5:
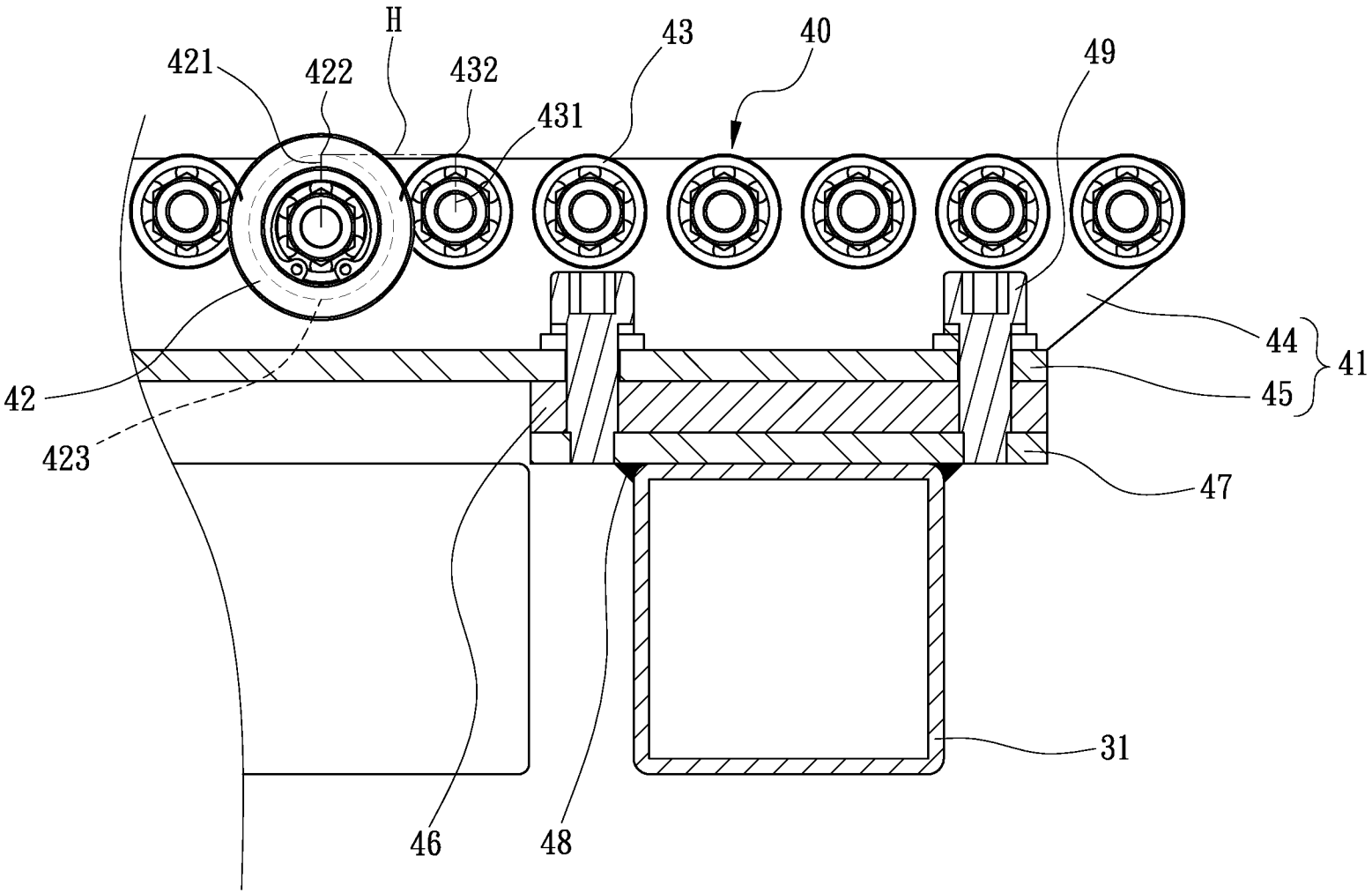
FIG. 5 is an enlarged partial view of the treadmill shown in FIG. 4.
Figure 6:
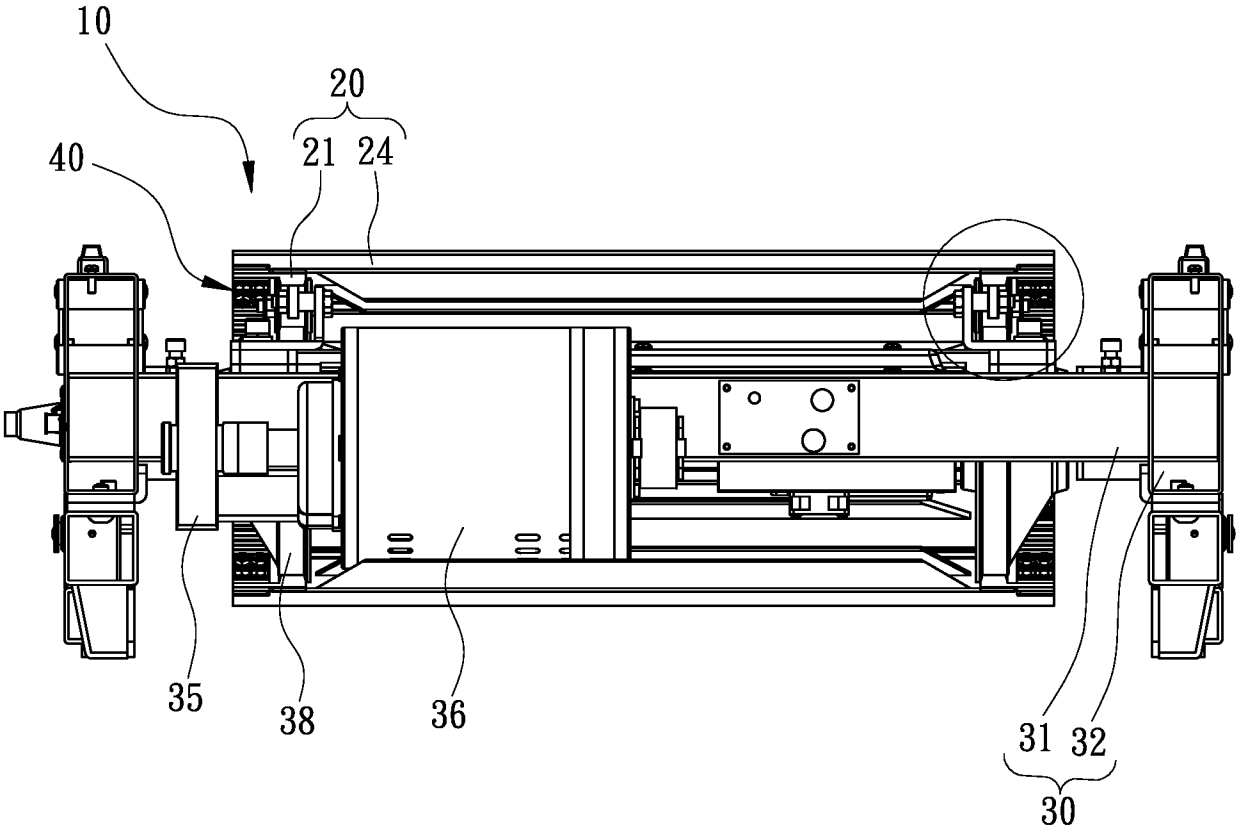
FIG. 6 is a cross-sectional view of the treadmill taken along a line C-C shown in FIG. 4.
Figure 7:
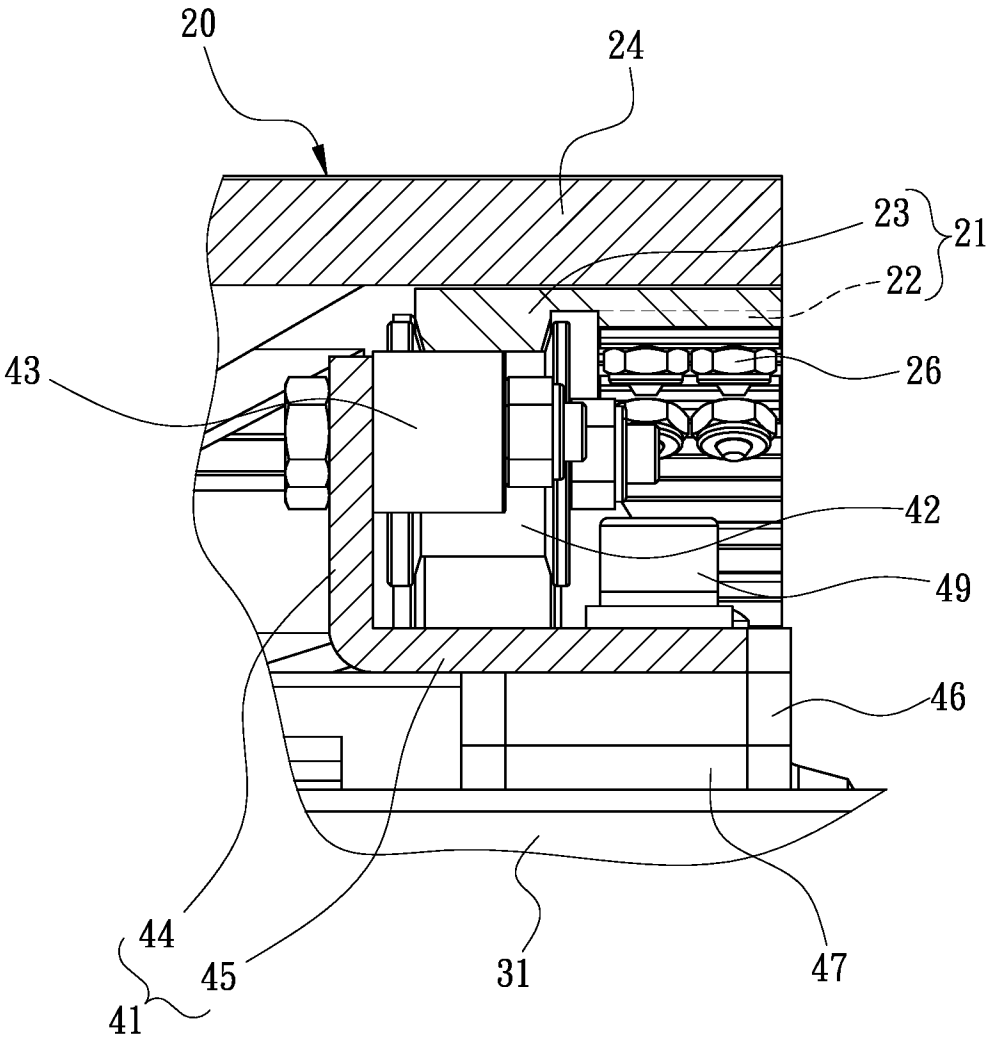
FIG. 7 is an enlarged partial view of the treadmill shown in FIG. 6.

Referring to FIGS. 4, 5 and 7, the cushion assemblies 40 are connected to the frame 30. Each of the cushion assemblies 40 includes a supporting element 41, a group of guiding wheels 42, a group of rollers 43 and two buffering elements 46. The supporting element 41 includes a vertical portion 44 and a horizontal portion 45, thereby rendering the supporting element 41 L-shaped (FIG. 7).

The guiding wheels 42 and the rollers 43 are supported on a same side of the vertical portion 44 of the supporting element 41. The diameter of the guiding wheels 42 is larger than that of the rollers 43. Each of the guiding wheels 42 includes a groove 423 in the periphery 422. The periphery 422 of each of the guiding wheels 42 includes a middle portion extending in the groove 423. The radius 421 of the middle portion of the periphery 422 of each of the guiding wheels 42 is identical to the radius 431 of the periphery 432 of each of the rollers 43. Thus, the middle portions of the peripheries 422 of the guiding wheels 42 and the peripheries 432 of the rollers 43 share a tangent plane. The tangent plane is located above the edge of the vertical portion 44, thereby keeping the corresponding loop 21 away from the edge of the vertical portion 44 of the supporting element 41.

Referring to FIGS. 2, 3 and 5 to 7, the tracking portion 23 of the corresponding loop 21 is inserted in the grooves 423 of the guiding wheels 42, thereby preventing the corresponding loop 21 from transverse movement relative to the guiding wheels 42. The tracking portion 23 of the corresponding loop 21 contacts the middle portions of the peripheries 422 of the guiding wheels 42 and the peripheries 432 of the rollers 43, thereby rending the upper portion of the tread assembly 20 horizontally movable on the horizontal portions 45 of the supporting elements 41 of the cushion assemblies 40.

Preferably, one of the buffering elements 46 is sandwiched between a portion of the supporting element 41 and one of the crossbars 31 near the rear end 12 of the treadmill 10. The other buffering element 46 is sandwiched between another portion of the supporting element 41 and another one of the crossbars 31 near the front end 14 of the treadmill 10. Each of the buffering elements 46 is sandwiched between a corresponding plate 47 and the horizontal portion 45 of the supporting element 41. Two fasteners 49 are inserted in the horizontal portion 45 of the supporting element 41, each of the buffering elements 46 and the corresponding one of the plates 47. Each of the fasteners 49 is preferably a screw with a threaded portion inserted in a screw hole made in the corresponding plate 47 and an enlarged head located on the horizontal portion 45 of the supporting element 41. Thus, the horizontal portion 45 of the supporting element 41 is movable relative to the plates 47 along the fasteners 49. However, the horizontal portion 45 of the supporting element 41, the buffering elements 46 and the plates 47 cannot be detached from one another.

Each of the buffering elements 46 is an elastic block or pad made of polyurethane ("PU") in the first embodiment. However, the buffering elements 46 can be made of rubber in another embodiment. Of course, each of the buffering elements 46 can be a helical or leaf spring in another embodiment.

Each of the plate 47 is a metal plate in the first embodiment. The plates 47 are attached to the crossbars 31 by soldering for example. Thus, there are points of solder 48 to connect the cushion assembly 40 to the frame 30.

When a user is on the treadmill, some of the slats 24 of the tread assembly 20 bear the weight of the user. The weight is transferred to the loops 21 from the slats 24. Then, the weight is transferred to the supporting elements 41 from the loops 21 since the guiding wheels 42 and the rollers 43 contact the loops 21. The supporting elements 41 are moved toward the crossbars 31, and the buffering elements 46 are compressed. Thus, the buffering elements 46 reduce an impact on the tread assembly 20 from the user and protect the user's ankles, knees and some other joints, thereby protecting the user from injuries.

Figure 8:
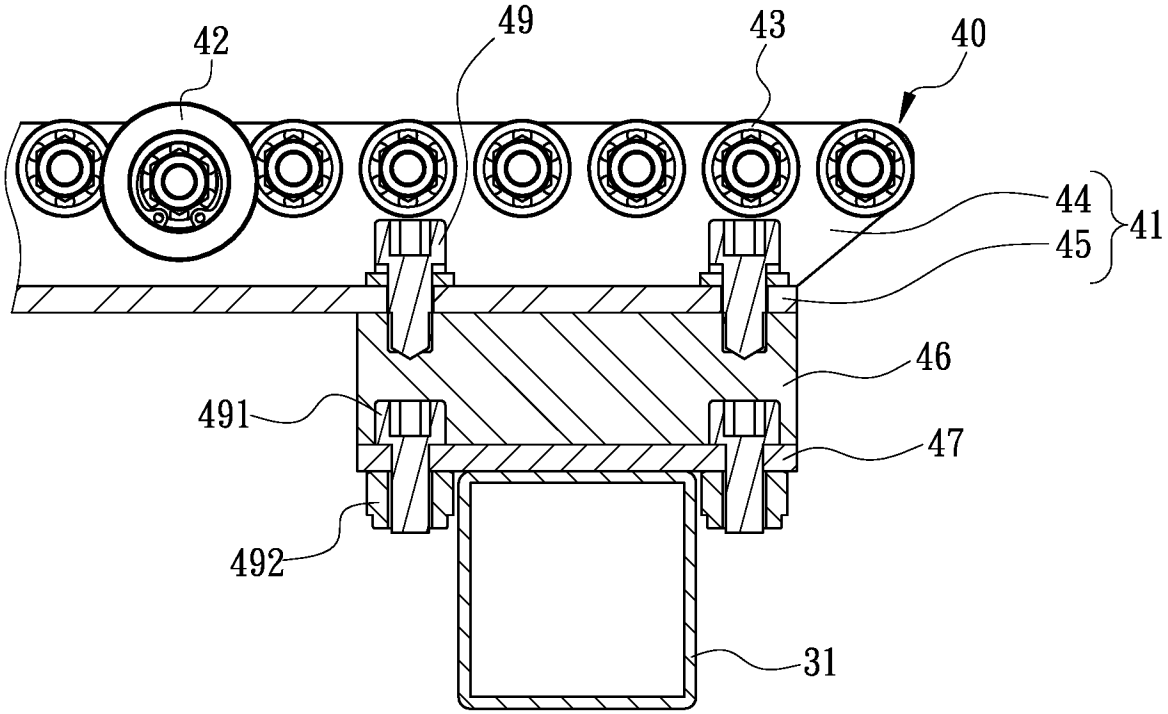
FIG. 8 is an enlarged partial cross-sectional view of a cushion assembly according to a second embodiment of the present invention.

Referring to FIG. 8, there is a treadmill 10 according to a second embodiment of the present invention. The second embodiment is identical to the first embodiment except for two things. Firstly, the fasteners 49 are only inserted in the horizontal portion 45 and the buffering elements 46, not in the plates 47. Secondly, two fasteners 491 are used to connect the buffering elements 46 to the horizontal portion 45 of the supporting element 41. Each of the fasteners 491 includes an enlarged head embedded in a corresponding one of the buffering element 46 and a threaded portion extending throughout two apertures made in a corresponding one of the plates 47 and engaged with a corresponding nut 492. Thus, each of the buffering elements 46 is kept between the corresponding plate 47 and the horizontal portion 45 of the supporting element 41.

Figure 9:
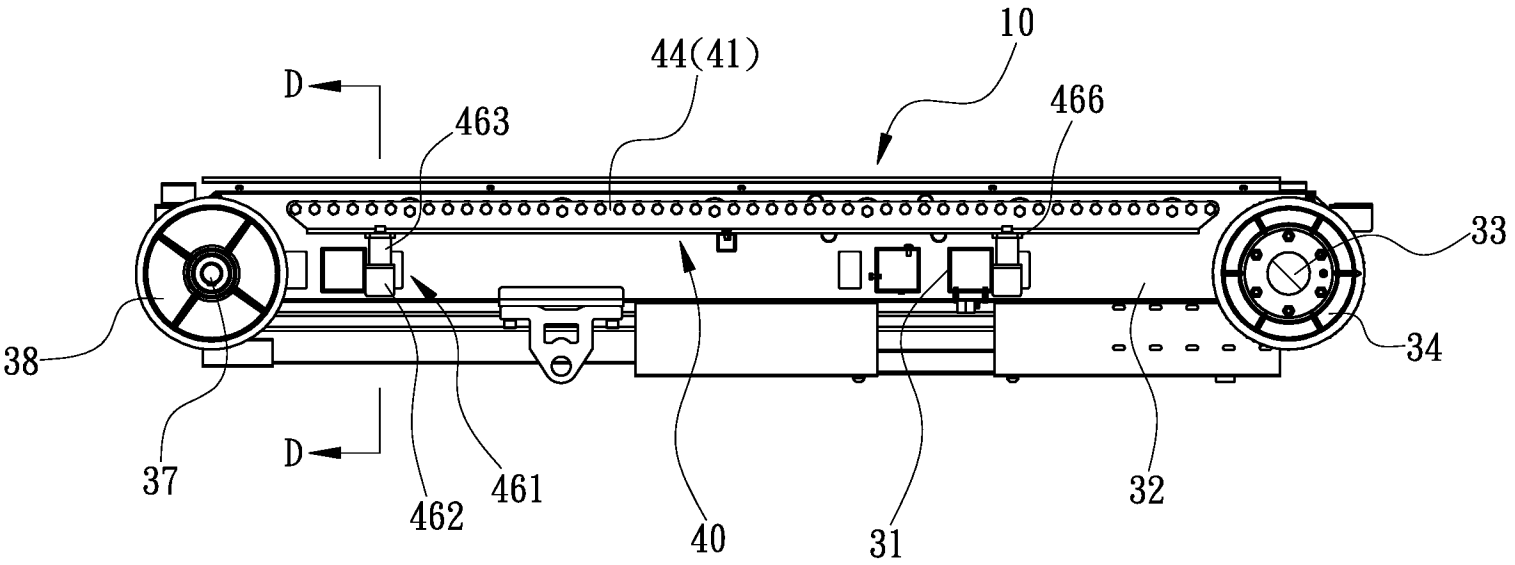
FIG. 9 is a cross-sectional view of a treadmill provided with a cushion assembly according to a third embodiment of the present invention.
Figure 10:
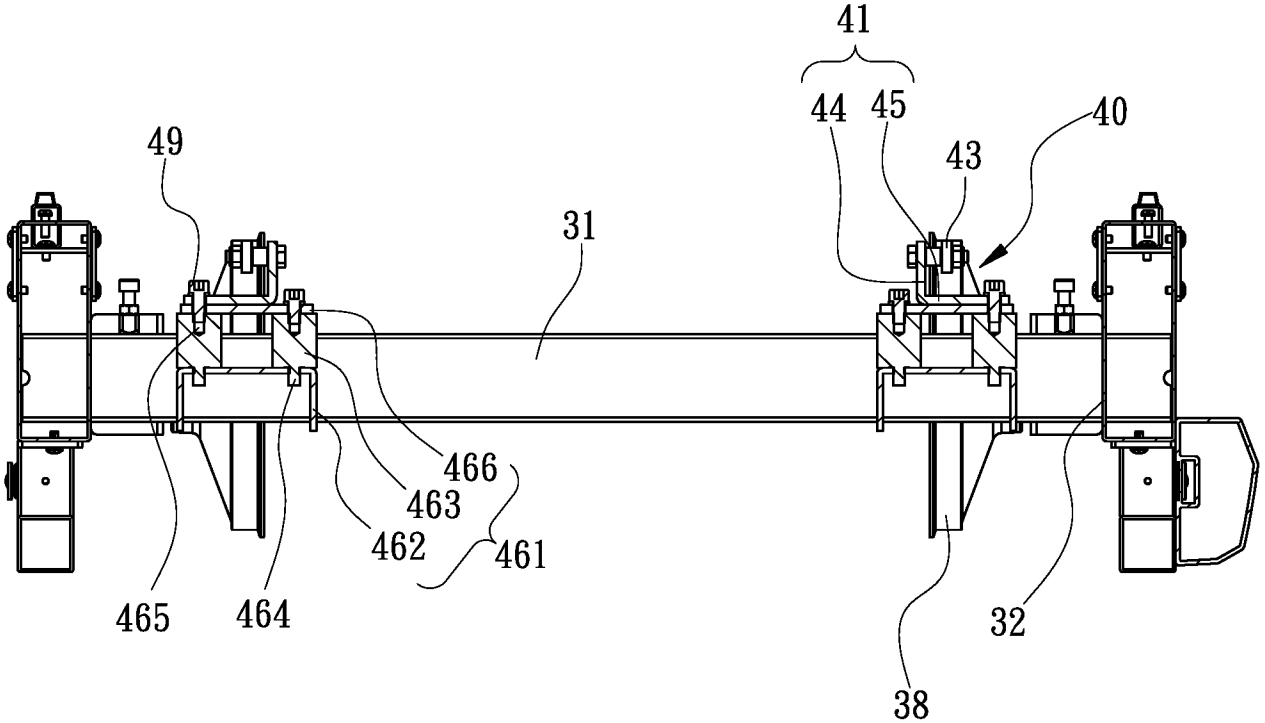
FIG. 10 is a cross-sectional view of the treadmill taken along a line D-D shown in FIG. 9.

Referring to FIGS. 9 and 10, there is a treadmill 10 according to a third embodiment of the preset invention. The third embodiment is identical to the first embodiment except for including buffering units 461 instead of the buffering elements 46. Each of the buffering units 461 includes a mount 462, several elastic rods 463 and a plate 466. The mount 462 is connected to a corresponding one of the crossbar 31 by soldering for example. The elastic rods 463 are made of PU for example. Each of the elastic rods 463 includes a protuberance 464 extending from an end and a recess 465 made in an opposite end. The protuberance 464 of each elastic rod 463 is fitted in a bore (not numbered) made in the mount 462, thereby connecting the elastic rod 463 to the mount 462. The recess 465 receives the threaded portion of a corresponding one of the fasteners 49 that extends throughout a corresponding one of multiple orifices (not numbered) in the horizontal portion 45 of the supporting element 41 and a corresponding one of multiple apertures (not numbered) in the plate 466. Thus, each of the buffering units 461 is sandwiched between the horizontal portion 45 of the supporting element 41 and the corresponding mount 462, which is connected to the corresponding crossbar 31.

Figure 11:
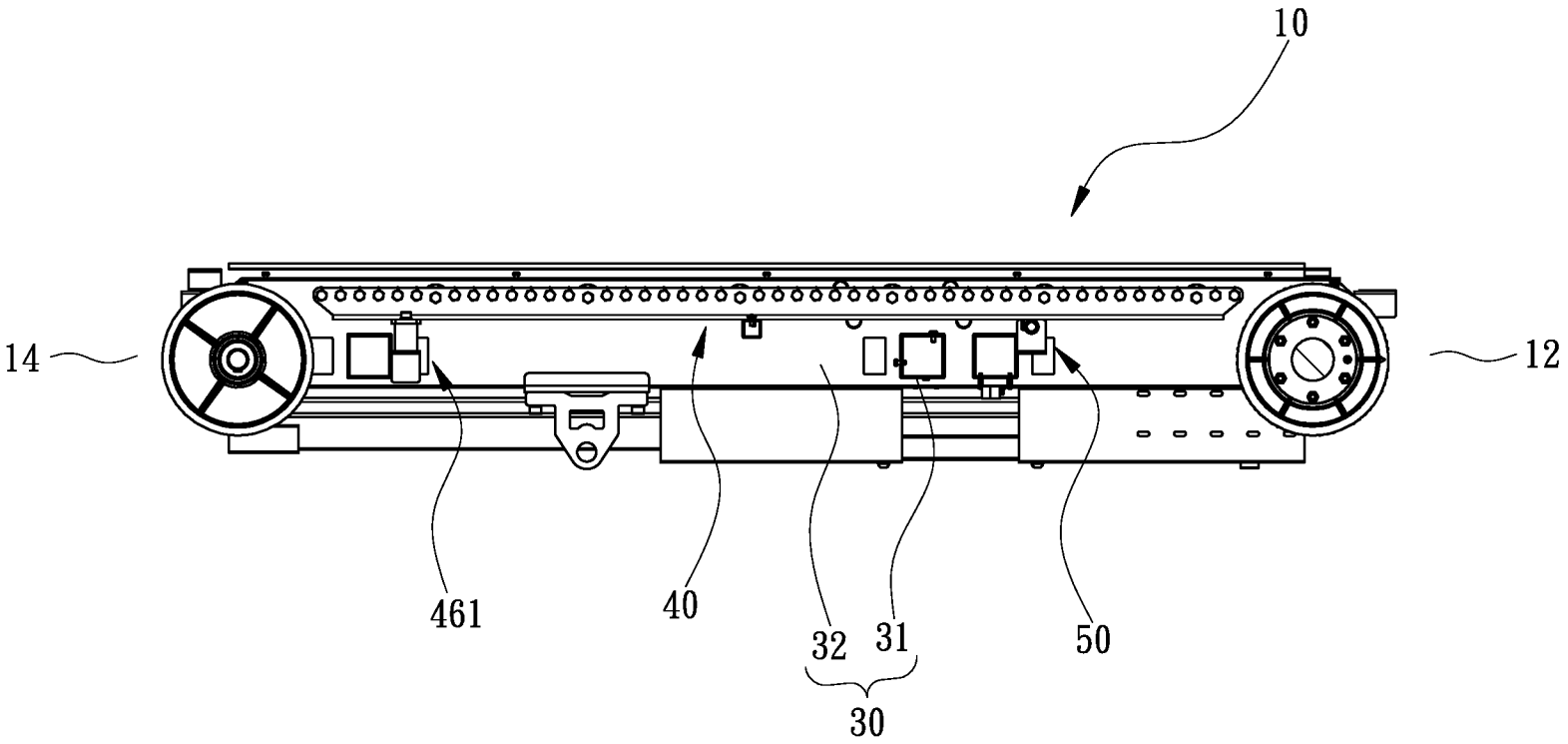
FIG. 11 is a cross-sectional view of a treadmill provided with a cushion assembly according to a fourth embodiment of the present invention.

Referring to FIG. 11, there is a treadmill 10 according to a fourth embodiment of the present invention. The fourth embodiment is identical to the third embodiment except that each of the cushion assemblies 40 includes a single buffering unit 461 and a pivotal unit 50. The pivotal unit 50 is used to connect a first portion of the supporting element 41 to a portion of the frame 30 in the vicinity of the rear end 12 of the treadmill 10. The buffering unit 461 is provided between a second portion of the supporting element 41 and the crossbar 31 near the front end 14 of the treadmill 10. Therefore, the first portion of the supporting element 41 is allowed to move down as the buffering unit 461 is compressed while the second portion of the supporting element

41 is allowed to pivot about the pivotal unit 50. Hence, the buffering effect is better near the front end 14 of the treadmill 10 than near the rear end 12.

Figure 12:
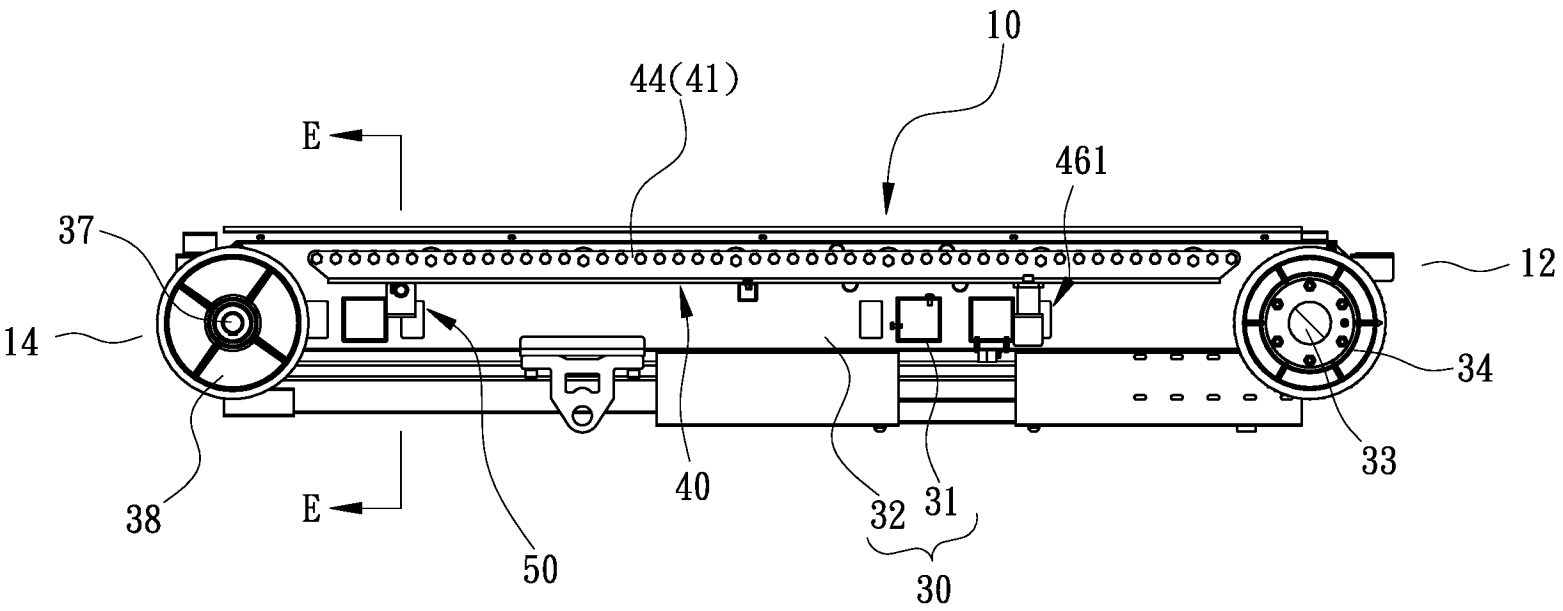
FIG. 12 is a cross-sectional view of a treadmill provided with a cushion assembly according to a fifth embodiment of the present invention.
Figure 13:
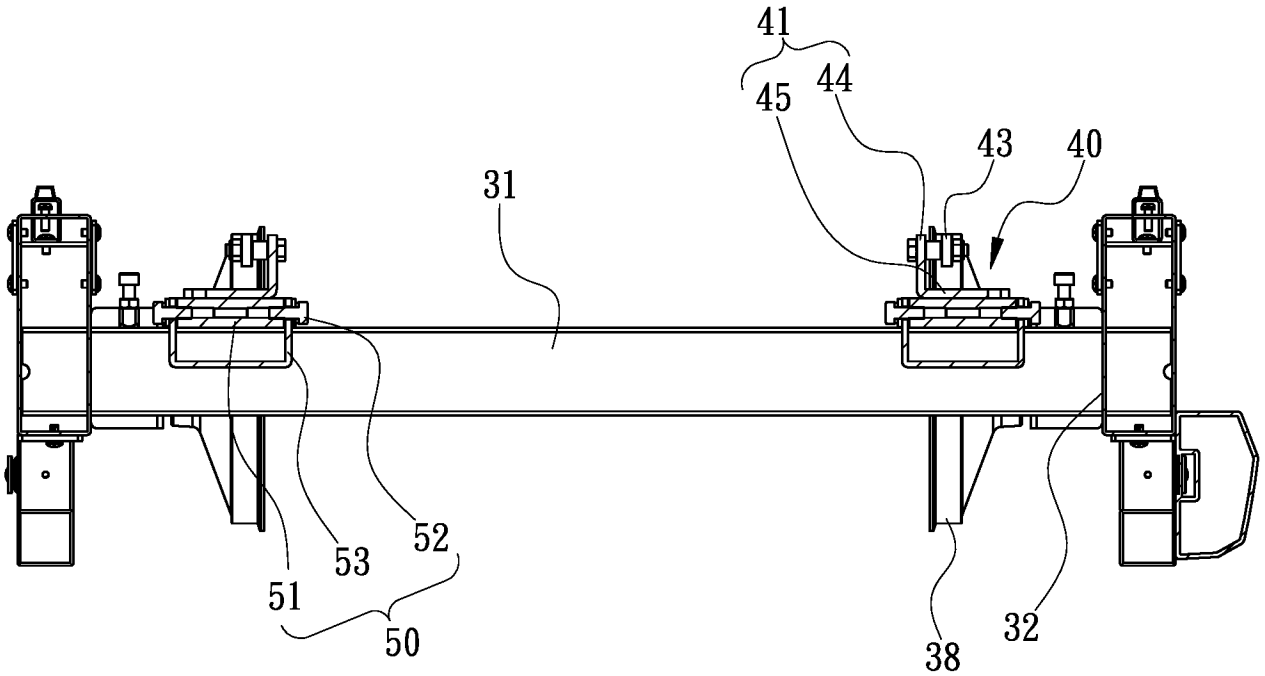
FIG. 13 is a cross-sectional view of the cushion assembly taken along a line E-E shown in FIG. 12.

Referring to FIGS. 12 and 13, there is a treadmill 10 according to a fifth embodiment of the present invention. The fifth embodiment is like the fourth embodiment except that the buffering unit 461 is provided between the first portion of the supporting element 41 and the crossbar 31 near the rear end 12 of the treadmill 10 while the pivotal unit 50 is used to connect the second portion of the supporting element 41 to a portion of the frame 30 near the front end 14 of the treadmill 10. Hence, the second portion of the supporting element 41 is allowed to move down as the buffering unit 461 is compressed while the first portion of the supporting element 41 is allowed to pivot about the pivotal unit 50. Hence, the buffering effect is better near the rear end 12 of the treadmill 10 than near the front end 14.

The pivotal unit 50 includes a sleeve 51, a pivot 52 and a mount 53. The mount 53 is U-shaped element connected to one of the crossbars 31 by soldering for example. The sleeve 51 is connected to a lower face of the horizontal portion 45 of the supporting element 41 by soldering for example. The sleeve 51 is inserted in the mount 53. The pivot 52 is inserted in the sleeve 51 and the mount 53. Preferably, the pivot 52 is in the form of a threaded bolt.

The present invention has been described via the illustration of the embodiments. Those skilled in the art can derive variations from the embodiments without departing from the scope of the present invention. Therefore, the embodiments shall not limit the scope of the present invention defined in the claims.

What is claimed is:

1. A treadmill-used cushion assembly comprising:

a supporting element for supporting an upper portion of a tread assembly of a treadmill; and two buffering units provided between the supporting element and a frame of the treadmill, wherein each of the buffering units comprises:

a mount connected to the frame of the treadmill and formed with bores;

a plate connected to the supporting element and formed with apertures;

elastic rods sandwiched between the mount and the plate, wherein each of the elastic rods comprises a protuberance extending from a first end into a corresponding one of the bores of the mount and a recess made in a second end; and fasteners inserted in the recesses of the elastic rods through the apertures of the plate.

* * * * *